US005588399A

United States Patent [19]

Kim

[11] Patent Number: 5,588,399

[45] Date of Patent: Dec. 31, 1996

[54] FLUE FOR WATER HEATER

[76] Inventor: Thomas K. Kim, 1168 Forest Vale La., BB-8, Norcross, Ga. 30093

[21] Appl. No.: 491,263

[22] Filed: Jun. 16, 1995

[51] Int. Cl.[6] ..... F22B 5/00

[52] U.S. Cl. ..... 122/17; 122/155.5

[58] Field of Search ..... 122/14, 16, 17, 122/18, 114, 116, 155.1, 155.4, 155.5; 126/361

[56] References Cited

U.S. PATENT DOCUMENTS

| | | | |
|---|---|---|---|
| 1,170,834 | 2/1916 | Lovekin | 122/17 |
| 1,438,260 | 12/1922 | Pilcher | 122/155.4 |
| 2,664,861 | 1/1954 | Alexander | 122/155.5 |
| 4,191,132 | 3/1980 | Rahikka | 122/155.4 |
| 4,936,260 | 6/1990 | Adams | 122/18 |

*Primary Examiner*—Noah P. Kamen
*Attorney, Agent, or Firm*—James B. Middleton

[57] ABSTRACT

A water heater has one or more flue openings through the tank to allow flue gases to pass through the tank and heat water in the tank. The flue openings are constricted at two or or more discrete locations. The transitions between the several sizes of the flue opening cause turbulence in the flow of the flue gases. It has been found that, with two or three cylindrical sections of the flue opening, each section being of successively smaller diameter, the flue gases assume a helical flow pattern which yields a longer path and more time for heat to be absorbed by the tank and the water therein. The result is a 35% to 45% greater efficiency in use of heat, a greater number of flue openings yielding the greater efficiency.

6 Claims, 1 Drawing Sheet

FLUE FOR WATER HEATER

BACKGROUND OF THE INVENTION

1. Field of the Invention

This invention relates generally to water heating, and is more particularly concerned with an efficient flue for use in a gas water heater or the like.

2. Discussion of the Prior Art

Gas has long been a preferred fuel for heating water for both industrial and domestic use. An early arrangement for gas water heaters was simply to dispose a burner below a water tank, and to allow the flue gases to flow around the tank so the tank, and the water within, will absorb heat from the flue gases. Later water heaters have had an opening through the center of the tanks so flue gases pass both around the outside and through the center of the tank, giving more surface area for absorption of heat from the flue gases.

Even though a generous surface is provided for absorbing heat into the tank from the flue gases, the gases still pass quickly from the burner to the flue due to the high temperature of the gas. Thus, there have been additional efforts at capturing more of the heat, such additional efforts comprising the use of baffles in the vicinity of the tank, the idea being that the baffles retard the flow of flue gas to prevent laminar flow, and to allow more time for the gas to stay in contact with the tank so the tank will absorb more of the heat. The use of baffles and the like surely increase the efficiency of the water heating somewhat, but the baffles are complex and expensive to install, and provide additional surfaces for the accumulation of soot. A coating of soot of course acts as an insulator and inhibits the absorption of heat by the water tank. Thus, some means is still needed to extract the maximum heat from the flue gases without undue complexity.

SUMMARY OF THE INVENTION

The present invention provides a water tank having at least one flue opening therethrough. The flue opening is incrementally constricted, providing distinct steps along the walls of the flue. The steps in the flue cause diversion of the flow of gases to slow the flow of flue gases. In slowing the flow, there is more time for the tank to absorb heat from the flue gas; yet, there are no complex baffles or the like.

The number of steps in the flue opening can be varied, depending on the size of the tank, the heat output of the burner etc. Also, the configuration of the steps can be varied to yield somewhat different gas flow patterns. Additionally, the number of flue openings can be varied depending on the size of the water tank.

In tests conducted during the development of the invention it was noticed that the flue gases rise in a helical pattern. Even the flame at the burner adopted a helical pattern, indicating that the entire gas column moves in a helical pattern through the central flue opening in the tank.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
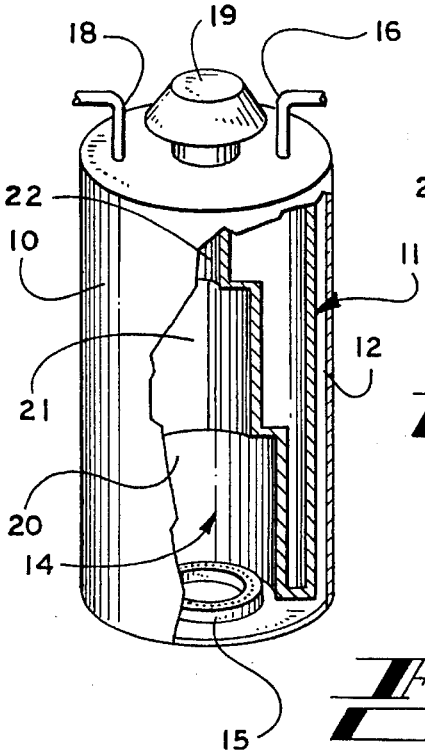
FIG. 1 is a perspective view, partially in cross-section, showing a domestic water heater having a single flue opening constructed in accordance with the present invention.

Referring now more particularly to the drawings and to that embodiment of the invention shown in FIG. 1, the water heater includes an outer casing 10 having a water tank 11 therein. Conventionally, heat insulating material will fill the space 12 between the tank 11 and the casing 10.

Centrally of the tank 11, there is a flue opening 14 having a gas burner 15 at the lower end thereof. As here shown, the burner 15 is completely within the flue opening 14 so virtually all the flue gases will pass through the opening 14. It will be understood, however, that the burner 15 may be partially disposed under the tank 11, so flue gases will pass both through the opening 14 and around the outside of the tank 11. This arrangement would provide a larger surface for the absorption of heat, but have no means for slowing the rate of travel of flue gas over the outside surface of the tank. Those skilled in the art can determine the desired arrangement based on the necessary rate of recovery and the desired economy.

To complete the water tank shown in FIG. 1, there are water inlet and outlet pipes 16 and 18, and an air mixer 19 for the discharged flue gases. It will of course be understood that a flue pipe will be connected to the air mixer 19 to conduct the gases to the outside.

Returning now to the flue opening 14, it will be noticed that the lowest section 20 of opening 14 is of a large diameter. The intermediate and highest sections 21 and 22 respectively are coaxial with the section 20, but are of successively smaller diameters. In the embodiment of FIG. 1, the transitions between the different diameters are immediate steps, so the surface of the flue opening has 90° turns.

Figure 2:
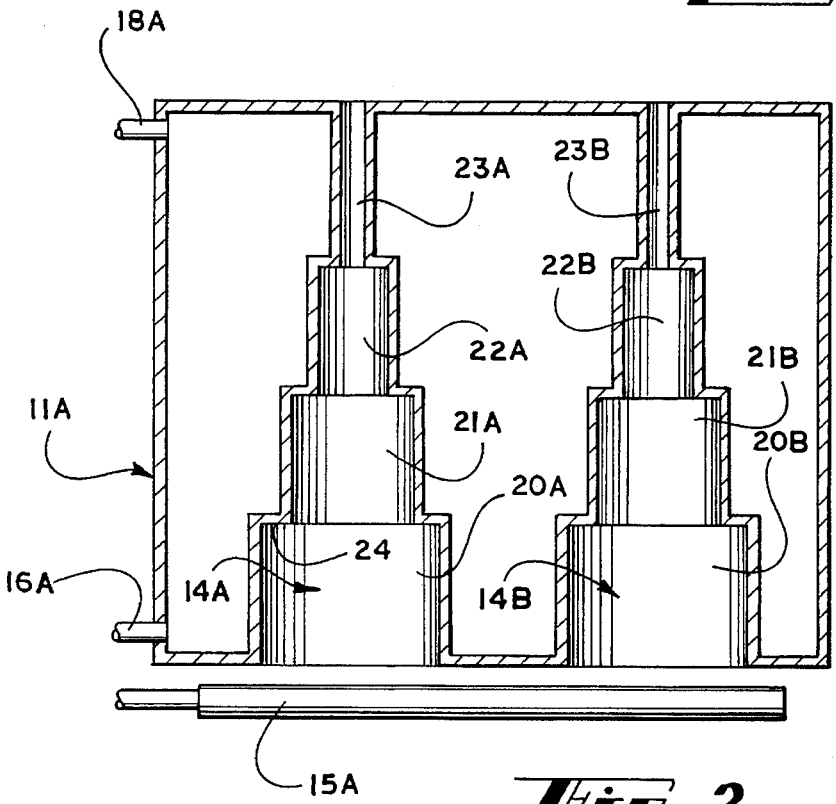
FIG. 2 is a diametrical cross-sectional view through an industrial water heater having a plurality of flues constructed in accordance with the present invention; and, FIGS. 3–5 are fragmentary details showing various shapes for the steps in the flue openings in accordance with the present invention.

Looking next at FIG. 2 of the drawings, it will be seen that the water tank construction is substantially the same as that shown in FIG. 1, but the tank is larger, and there are two flue openings 14A and 14B. The water heater shown in FIG. 2 is intended to represent an industrial or institutional water heater, and no outer jacket or the like is included.

In FIG. 2, the parts comparable to parts in FIG. 1 carry the same reference numeral with an A or B suffix, so the tank is designated at 11A, one flue opening is designated at 14A, and the other at 14B. There is a gas burner 15A below the tank 11A. As was previously discussed, the burner 15A is larger so some flue gas may be allowed to flow around the outside surface of the tank 11A. The tank 11A has inlet and outlet pipes 16A and 18A.

The flue opening 14A and 14B are alike, so only one will be described in detail. As here shown, the flue 14A has four sections of different diameters, the sections being designated at 20A, 21A, 22A and 23A, and being coaxial with one another. From tests conducted, the flue gas moves through a helical path as it moves up through the flue opening 14A. Though the exact reason for the helical pattern is not fully understood, it has been discovered that the stepped configuration of the flue opening causes the helical pattern of the flue gas. It will be recognized that rising flue gas will engage the first step 24, and the smooth flow will be interrupted. The gas will be forced to move towards the center of the opening 14A to continue to rise. Meanwhile, some of the gas will attempt to pass directly up, through the center of the opening 14A. The result will be due to a number of forces and effects; but, it has been observed that the flue gases assume a helical pattern in rising through the flue opening 14A.

Those skilled in the art will readily understand that the slowing of the passage of the flue gases, and the lengthening of the exit path, will allow more time and opportunity for the tank 11A and the water therein to absorb heat from the flue gases. The provision of steps 24 and the like will tend to cause the gas flow to be turbulent, again assuring the best opportunity to transfer heat from the flue gas to the water.

Tests were conducted to determine the improvement obtained with the present invention. In the tests, a comparison was made among a conventional flue opening with a straight tube, a device according to the present invention having one flue opening, and a device according to the present invention having three or more flue openings. Two separate tests were conducted, the first test holding the heat input constant and obtaining varying amount of recovery of water having a 100° F. rise in temperature. The results of the first test were as follows:

| Flue Type | Capacity/ hour | BTU Input | Gals. heated to 100° F. Rise |
|---|---|---|---|
| Straight line tube | 80 Gal. | 200,000 | 200 |
| One stepped tube | 80 Gal. | 200,000 | 270 |
| Three stepped tubes | 80 Gal. | 200,000 | 290. |

It will be noted that, with the same heat input, the one stepped tube flue opening provided a 35% increase in the number of gallons of water having a 100° increase in temperature. Three stepped tube flue openings provided a 45% increase. The tests were carried further, testing more than three steps in the flue opening, but no increase in efficiency was noted.

In the second test, the number of gallons of water heated to a 100° F. rise in temperature was held constant, and the heat input was varied. Other parameters were the same as above, and the results were as follows:

| Flue Type | Capacity/ hour | BTU Input | Gals. heated to 100° F. Rise |
|---|---|---|---|
| Straight line tube | 80 Gal. | 200,000 | 200 |
| One stepped tube | 80 Gal. | 130,000 | 200 |
| Three stepped tubes | 80 Gal. | 110,000 | 200. |

This time, there was a 35% saving in the heat input using one stepped tube flue opening, and a 45% saving using three stepped tube flue openings. A saving in heat input is of course directly related to a saving in fuel consumed.

Figure 4:
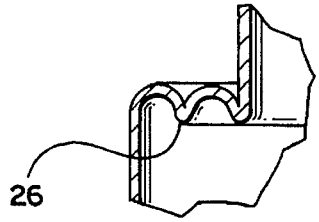
Figure 5:
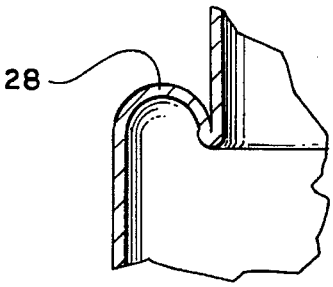

Both FIGS. 1 and 2 illustrate steps such as the step 24 as straight, 90° turns. While this construction is simple and effective, many different configurations can be used, and other suggested configurations are shown in FIGS. 3–5.

Figure 3:
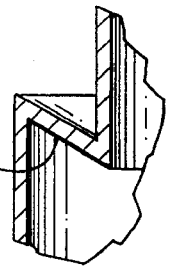

In FIG. 3, the step, here designated at 25, presents an acute angle to the rising flue gases. Probably some eddy currents will form beneath the step 25 to retard the rise of gas. In FIG. 4, the step is designated at 26 and includes two hemi-toroids. This construction will probably induce eddy currents in each hemi-toroid, allowing a considerable amount of heat to be transferred into the water at the step 26. Finally, FIG. 5 illustrates a step 28 formed as a single, but relatively large, hemi-toroid. The gas flow pattern should be similar to that of FIG. 3.

It will therefore be understood that the present invention provides a water heater having improved efficiency in recovery of heat from flue gases. The stepped flue opening delays the upward flow of gas, and creates enough turbulence in the flow that more heat is transferred into the water tank, and less is discharged to the atmosphere. As a result, the tank of the present invention is more economical to operate, and is better for the environment.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A water heater comprising a water tank defining at least one flue opening through said water tank, heating means disposed beneath said water tank and generally aligned with said flue opening so the heat rising from said heating means will pass through said flue opening, said flue opening comprising at least a first section having a relatively large diameter and a second section having a smaller diameter than said first section, a step defined between said first section and said second section, said step consisting of the transition between said first section and said second section, said first section and said second section being coaxial, and wherein said step comprises a surface disposed at an acute angle with respect to the wall of said first section.

2. A water heater comprising a water tank defining at least one flue opening through said water tank, heating means disposed beneath said water tank and generally aligned with said flue opening so that heat rising from said heating means will pass through said flue opening, said flue opening comprising at least a first section having a relatively large diameter and a second section having a smaller diameter than said first section, a step defined between said first section and said second section, said step consisting of the transition between said first section and said second section, said fist section and said second section being coaxial, and wherein said step comprises a hemi-toroidal surface.

3. A water heater comprising a water tank defining at least one flue opening through said water tank, heating means disposed beneath said water tank and generally aligned with said flue opening so that heat rising from said heating means will pass through said flue opening, said flue opening comprising at least a first section having a relatively large diameter and a second section having a smaller diameter than said first section, a step defined between said first section and said second section, said step consisting of the transition between said first section and said second section, said first section and said second section being coaxial and wherein said flue opening includes a third section having a diameter smaller than the diameter of said second section, said first section being at the bottom of said flue opening and said third section being at the top of said flue opening, so that the path for heat from said heating means is successively constricted.

4. A water tank as claimed in claim 3, wherein said first, second and third sections are coaxial.

5. A water tank as claimed in claim 4, wherein said heating means consists of a gas burner, and said heat from said heating means consists of flue gases.

6. A water heater as claimed in claim 3, wherein said at least one flue opening comprises a plurality of flue openings through said water tank, said heating means extending beneath all of said plurality of flue openings.

* * * * *